US007509904B2

(12) United States Patent
Plumier

(10) Patent No.: US 7,509,904 B2
(45) Date of Patent: Mar. 31, 2009

(54) DEVICE FOR THE REMOTE CONTROL OF A FIREARM

(75) Inventor: Philippe Plumier, Alleur (BE)

(73) Assignee: FN Herstal S.A., Herstal (BE)

( * ) Notice: Subject to any disclaimer, the term of this patent is extended or adjusted under 35 U.S.C. 154(b) by 0 days.

(21) Appl. No.: 11/633,521

(22) Filed: Dec. 5, 2006

(65) Prior Publication Data

US 2007/0261544 A1 Nov. 15, 2007

(30) Foreign Application Priority Data

Dec. 5, 2005 (BE) ..... 2005/0587

(51) Int. Cl.
*F41G 5/06* (2006.01)

(52) U.S. Cl. ..... 89/41.05; 89/41.02; 89/41.15; 89/41.17; 89/41.12

(58) Field of Classification Search ..... 89/41.02, 89/41.05, 41.15, 203–205, 41.17; 235/407
See application file for complete search history.

(56) References Cited

U.S. PATENT DOCUMENTS

| | | | | |
|---|---|---|---|---|
| 3,019,711 | A * | 2/1962 | Balley | 89/41.02 |
| 4,574,685 | A * | 3/1986 | Sanborn et al. | 89/37.14 |
| 4,577,546 | A * | 3/1986 | Jackson | 89/41.19 |
| 4,579,035 | A * | 4/1986 | Whiting | 89/41.05 |
| 4,686,888 | A * | 8/1987 | Sanborn et al. | 89/37.13 |
| 5,171,933 | A * | 12/1992 | Eldering | 89/41.06 |
| 5,410,398 | A * | 4/1995 | Appert et al. | 356/141.3 |
| 5,686,690 | A * | 11/1997 | Lougheed et al. | 89/41.17 |
| 5,949,015 | A | 9/1999 | Smith et al. | |
| 6,499,382 | B1 * | 12/2002 | Lougheed et al. | 89/41.05 |
| 6,679,158 | B1 * | 1/2004 | Hawkes et al. | 89/41.05 |
| 6,708,597 | B2 * | 3/2004 | Meyers et al. | 89/41.19 |
| 6,769,347 | B1 * | 8/2004 | Quinn | 89/41.05 |
| 7,021,188 | B1 * | 4/2006 | Berkovich et al. | 89/41.17 |
| 7,089,845 | B2 * | 8/2006 | Friedli et al. | 89/41.05 |
| 7,210,391 | B2 * | 5/2007 | Beckmann | 89/37.03 |
| 7,231,862 | B1 * | 6/2007 | Quinn | 89/41.05 |
| 7,293,493 | B2 * | 11/2007 | Persson et al. | 89/41.02 |
| 2003/0000372 | A1 * | 1/2003 | Meyers et al. | 89/41.06 |

(Continued)

FOREIGN PATENT DOCUMENTS

| | | |
|---|---|---|
| DE | 3404202 | 5/1987 |

(Continued)

*Primary Examiner*—Stephen M Johnson
*Assistant Examiner*—Daniel J Troy
(74) *Attorney, Agent, or Firm*—Bacon & Thomas, PLLC

(57) ABSTRACT

A device for the remote control of a firearm has a turret head which can be pointed in all directions and is controlled by an azimuth motor. A frame which fixes the firearm is suspended in an upward tilting manner in a pintle of the turret head. A sighting camera is connected to a screen which displays a sighting reticule. A remote control controls the azimuth motor and an elevation motor which controls an elevation of the frame. At least one sensor determines the orientation of either or both the frame and the camera and a ballistic calculator connected to the sensors to calculate and control the super elevation of the frame as a function of the information from the sensors and the distance of the target, such that the camera is driven by the elevation motor, and the frame can be inclined in elevation in relation to the camera.

11 Claims, 4 Drawing Sheets

U.S. PATENT DOCUMENTS

| | | | | |
|---|---|---|---|---|
| 2004/0050240 | A1 * | 3/2004 | Greene et al. | 89/41.06 |
| 2008/0034954 | A1 * | 2/2008 | Grober | 89/41.05 |

FOREIGN PATENT DOCUMENTS

| | | |
|---|---|---|
| FR | 2 484 626 | 12/1981 |
| FR | 2 281 928 | 9/2002 |
| FR | 2821 928 | 9/2002 |
| GB | 1294006 | 10/1972 |

* cited by examiner

DEVICE FOR THE REMOTE CONTROL OF A FIREARM

FIELD OF THE INVENTION

The invention concerns a device for the remote control of a firearm.

BACKGROUND OF THE INVENTION

A device for the remote control of a firearm generally consists of an all-directional turret head to be mounted for example on a vehicle or on a fixed or mobile carriage and which comprises a pintle carrying a frame which serves as a fixing support for the firearm and which is suspended in an upward tilting manner in said pintle of the turret head.

In order to point the firearm in the direction of a target, the swiveling of the turret head is controlled by an azimuth motor and the inclination of the frame and thus of the firearm is controlled by an elevation motor.

For the remote control of the firearm, the device is provided with a camera whose aiming axis is oriented in the direction of the barrel of the firearm.

Said camera is mounted on the device in such a manner that it follows the movements of the firearm, controlled by the operator, which enables the operator to localize the target on a screen, via said controls, and to aim at the target through a reticule visible on screen.

The screen and the remote control of the operator may be situated at a distance from the turret head, which makes it possible to control the firearm from a distance.

The effect of gravity on a fired projectile results in that the projectile follows a curved ballistic trajectory, which makes it necessary to raise the axis of the firearm in relation to the aiming axis.

Ballistic compensation as a function of the firing distance is necessary to guarantee a good firing precision. Said ballistic compensation is also known as super elevation.

Devices whose camera is made in one piece with the frame are already known, which results in that the movements of the camera are entirely synchronized with the movements of the firearm supported by the frame. Thus, the camera and the firearm are raised by one and the same motor.

A disadvantage of these devices is that, when the firing angle is high, for example when the firing distance is long, the ballistic compensation may result in that the target is no longer visible on screen for the operator, which has for a result that firing becomes very imprecise, if not impossible.

Devices whereby the frame and thus the firearm are raised by a first motor, whereas the camera is directed by a second, independent motor are already known as well.

A device of this type is disadvantageous in that it is relatively complex, heavy and expensive, and in that its maintenance costs are relatively high.

The invention aims to remedy one or several of the above-mentioned disadvantages and to provide a device for the remote control of a firearm which allows for a good firing precision and whose construction is relatively simple.

SUMMARY OF THE INVENTION

According to the invention, this aim is reached by an improved device for the remote control of a firearm, which comprises a turret head which can be pointed in all directions, controlled by an azimuth motor; a frame for fixing the firearm which is suspended in an upward tilting manner in a pintle which is part of said turret head; a sighting camera connected to a screen displaying a sighting reticule; a single elevation motor to control the elevation of the frame and the camera; a remote control to control the azimuth motor and the elevation motor; one or several sensors to determine the orientation of the frame and/or of the camera and a ballistic calculator connected to said sensors to calculate and control the super elevation of the frame as a function of the information from the sensors and the distance of the target, characterized in that the camera is driven by the above-mentioned elevation motor and in that the frame can be inclined in elevation in relation to the camera, whereby said frame is driven by the elevation motor via a super elevation jack placed between the frame and the motor, whereby the super elevation of the frame is controlled by the elongation of said jack, calculated by the ballistic calculator.

The camera and the frame are thus driven simultaneously by one and the same elevation motor, whereas the super elevation of the frame is obtained by means of an elongation of the super elevation jack which is placed between the elevation motor and the frame and thus also between the camera and the frame, so as to obtain a shift between the elevation of the camera and the elevation of the frame.

In this manner, the raised position of the camera and the raised position of the frame are uncoupled so to say, which is advantageous in that the operator can always see the target on screen, whereas the ballistic calculator has the possibility to introduce the necessary super elevation of the frame as a function of the distance of the target.

Another advantage of a device according to the invention is the relative simplicity of the construction of the device and its components, which is advantageous as far as price and maintenance costs are concerned, without compromising the firing precision however.

According to a preferred embodiment of the invention, the elevation motor is situated on one side of the frame, whereas the camera is situated on the other side of the frame, whereby the camera is coupled directly to the elevation motor by means of a mechanical coupling in the form of a bridge between the elevation motor and the camera, thus avoiding to disrupt the supply and ejection of the ammunition.

Said mechanical bridge is preferably mounted under the frame so as to simplify the mounting of the firearm on the frame, as well as its dismounting.

BRIEF DESCRIPTION OF THE DRAWINGS

For clarity's sake, the following examples of an embodiment of an improved device according to the invention for the remote control of a firearm are described hereafter as an example only without being limitative in any way, with reference to the accompanying drawings, in which.

DETAILED DESCRIPTION OF THE PREFERRED EMBODIMENTS

Figure 1:
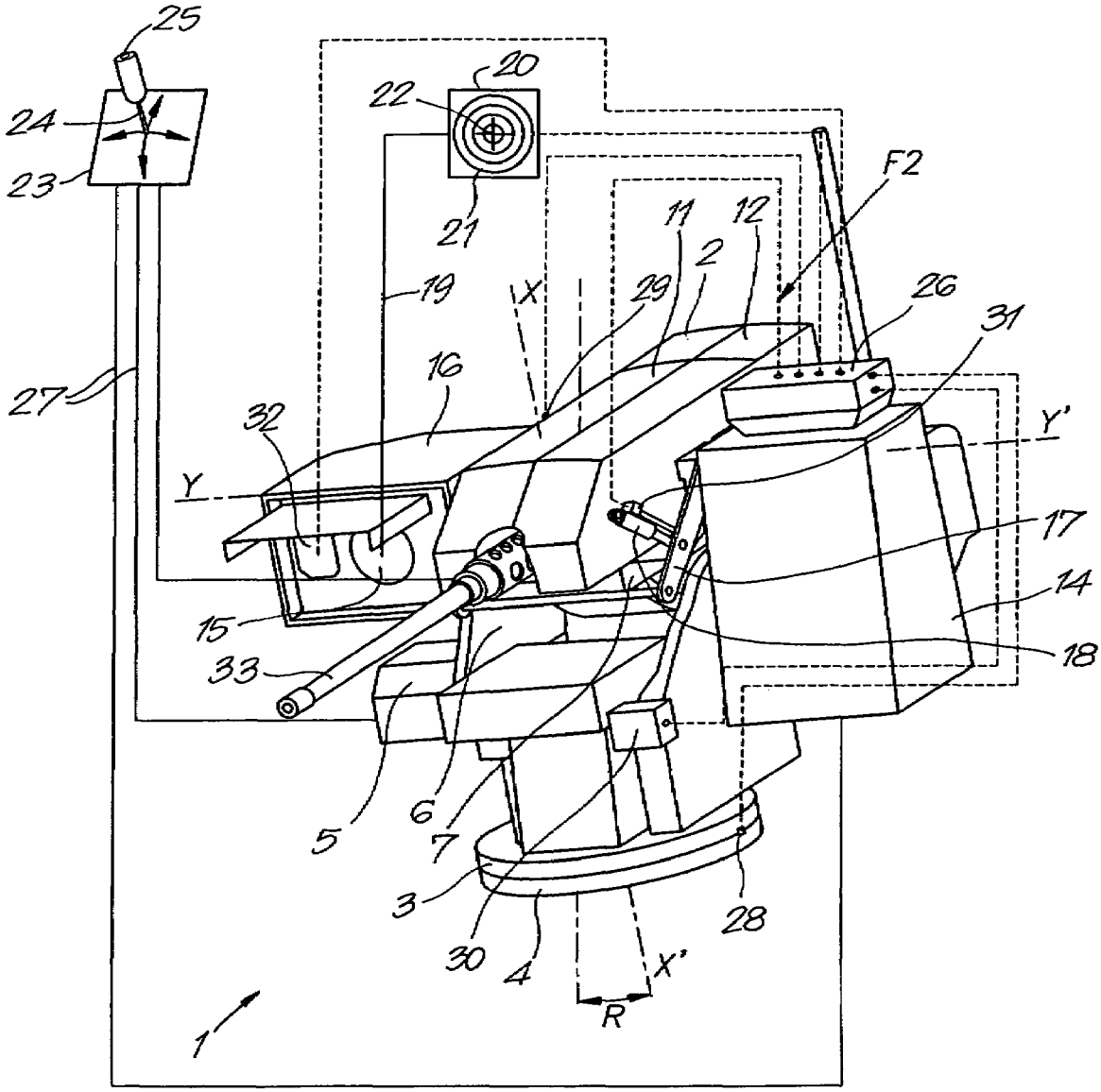
FIG. 1 is a view in perspective of a device according to the invention for the remote control of a firearm mounted in the device.

FIG. 1 represents an improved device 1 according to the invention for the remote control of a firearm 2, which is a machine gun in the given example.

The device 1 comprises a turret head 3 which can be pointed in all directions, provided with a bearing 4 for mounting the turret head 3 on a vehicle or any other basis and which enables the turret head 3 to rotate round an axis X-X', controlled by an azimuth motor 5.

The turret head 3 comprises a pintle 6 in which the frame 7 is suspended in an upward tilting manner round an axis Y-Y' by means of two hinge points 8.

Figure 2:
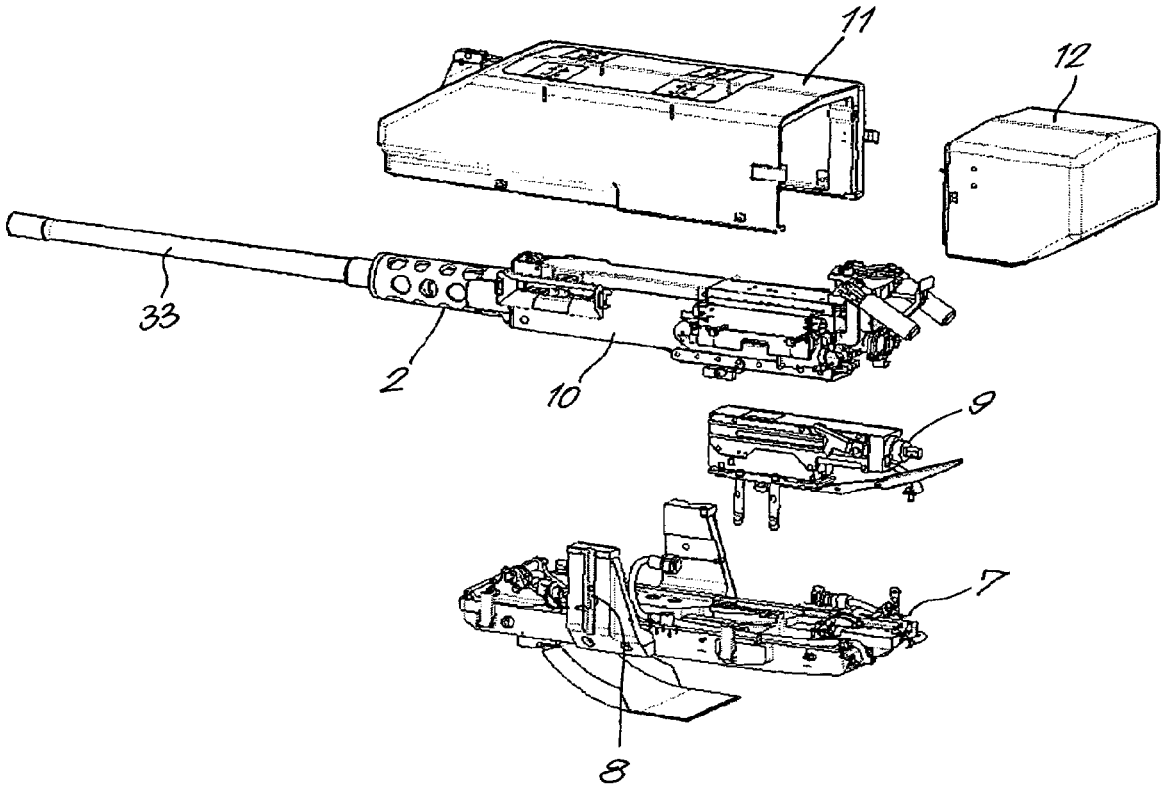
FIG. 2 is an exploded view of the part indicated by F2 in FIG. 1.
Figure 3:
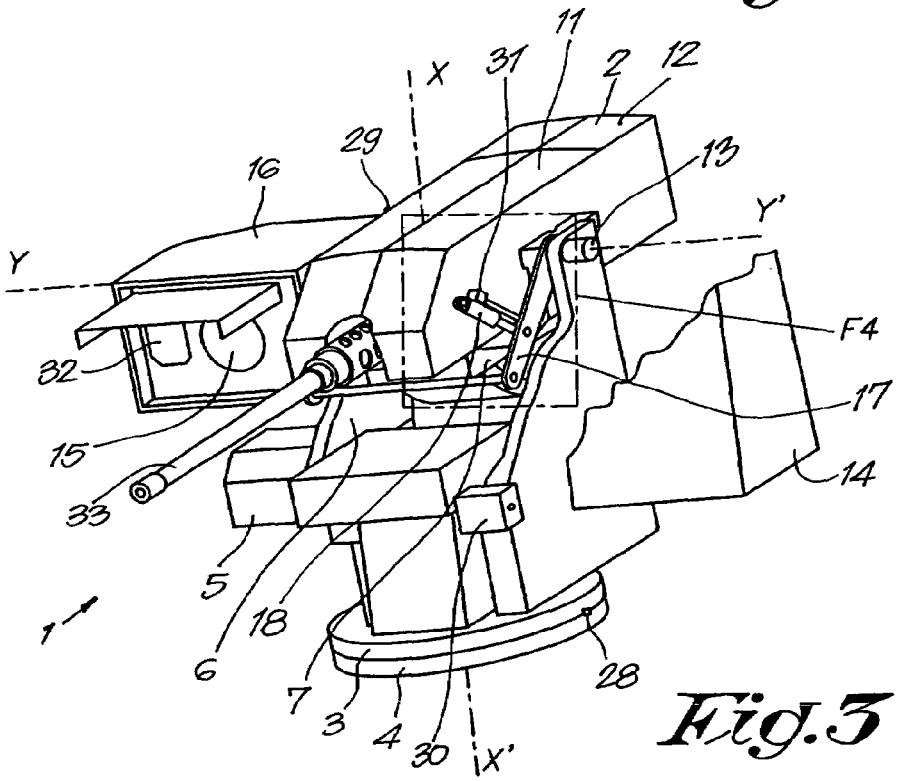
FIG. 3 is a view similar to that in FIG. 1, but in which some parts have been omitted.
Figure 4:
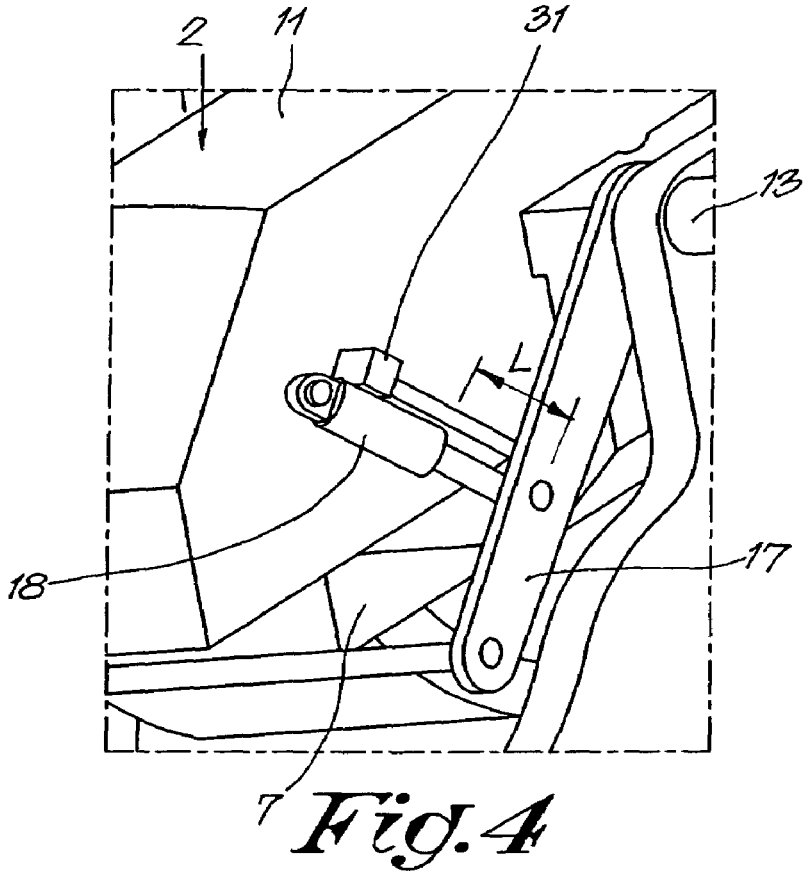
FIG. 4 represents the part indicated by F4 in FIG. 3.

As represented in FIG. 2, the frame 7 serves as a support for fixing the firearm 2 on the device 1 and in this case comprises a cradle 9 which makes it possible to stop and guide the movement of the firearm 2 in the axial direction in a known manner, since we know that the firearm 2 tends to recoil as a result of the reactive forces of the propulsion gases of the fired ammunition.

The firearm 2 is mounted with its receiver 10 on the frame 7 and is protected by means of two protection caps 11 and 12.

An elevation motor 13 is mounted on the turret head 3, preferably in an armored framework 14 situated on one side of the frame 7.

A sighting camera 15 is provided in an armored framework 16 on the other side of the frame 7, enabling the operator to visualize the target, whereby the camera 15 or the framework 16 is connected directly to the output shaft of the elevation motor 13 via a mechanical coupling 17, for example in the form of a mechanical bridge which, in the case of the figures, goes under the frame 7.

As a result, the elevated position of the camera 15 is directly controlled by the elevation motor 13.

The frame 7 on the other hand, is also directly controlled by the same elevation motor 13 as mentioned above, but indirectly by means of an electric super elevation jack 18 situated at right angles to the axis of the elevation motor 13 which coincides with the above-mentioned elevation axis Y-Y' and situated at a distance from said axis Y-Y'.

The sighting camera 15 is connected to a screen 20 displaying the target 21 as well as a sighting reticule 22 via wiring 19 or via a wireless connection of the RF type or any other type whatsoever.

The camera 15 can be situated on the turret head 3 or at a distance from the latter.

A remote control 23 is provided so as to enable the operator to control the movements of the azimuth motor 5 and of the elevation motor 13 so as to direct the camera 15 and the frame 7 towards the target 21.

The remote control 23 may be a bidirectional control lever 24, for example, provided with a trigger 25 to control the firing.

Said remote control 23 is connected directly or indirectly to the motors 5 and 13 by means of a controller and a ballistic calculator 26, and to the firearm 2 by means of electric wiring 27 or via a wireless connection.

The ballistic calculator 26 is coupled to one or several sensors to determine the orientation of the frame 7 and/or of the camera 15, including for example a sensor 28 to determine the azimuth of the turret head 3, a sensor 29 to determine the elevation of the camera 15, a sensor 30 to determine the roll angle R of the turret head 3 and an encoder 31 to determine the elongation L of the super elevation jack 18, as well as a range finder 32 allowing to measure the distance between the device 1 and the target 21.

The ballistic calculator 26 comprises software which makes it possible to calculate the super elevation to be provided to the frame 7 by means of the super elevation jack 18 as a function of the information obtained from the sensors 28, 29 and 30, from the range finder 32 and the control information from the encoder 31.

The working of the device 1 is as follows.

When aiming, the camera 15 and the firearm 2 are initially directed in the same direction, whereby the super elevation jack is situated in a neutral position.

Figure 5:
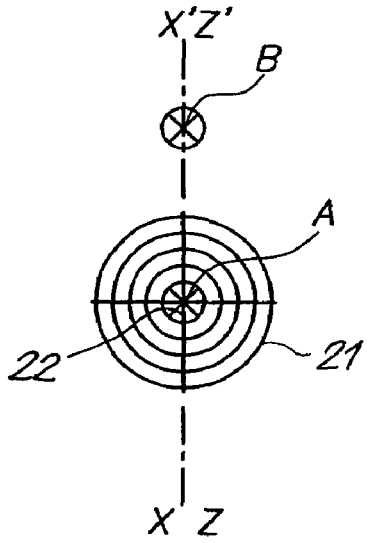
FIG. 5 is a view of the image on the sighting screen.

By means of the remote control 23, the operator controls the movement of the azimuth motor 5 and of the elevation motor 13 so as to position the sighting camera 15 in such a manner that the target 21 is displayed on the screen 20 and so as to position the reticule 22 of the screen 20 on the target 21 as represented in FIG. 5, in which the reference mark * represents the position of the axis of the barrel 33 of the firearm 2, whereby the position A is the position when aiming.

When the target 21 is being aimed at, the operator obtains the distance at which the target 21 is situated by activating the range finder 32.

The information regarding the distance is transmitted to the ballistic calculator 26 which calculates the super elevation to be provided to the frame 7 in order to be able to hit the target 21, and which adjusts the position of the firearm 2 by a corresponding elongation of the super elevation jack 18 so as to obtain a position of the axis of the barrel 33 which corresponds to the position B in FIG. 5.

The case of FIG. 5 corresponds to a situation in which the axis of rotation X-X' of the turret head is vertical, which corresponds to a roll angle zero.

In reality, the bearing 4 of the turret head is not always horizontal, the axis X-X' forming a roll angle R with the vertical line Z-Z'.

Figure 6:
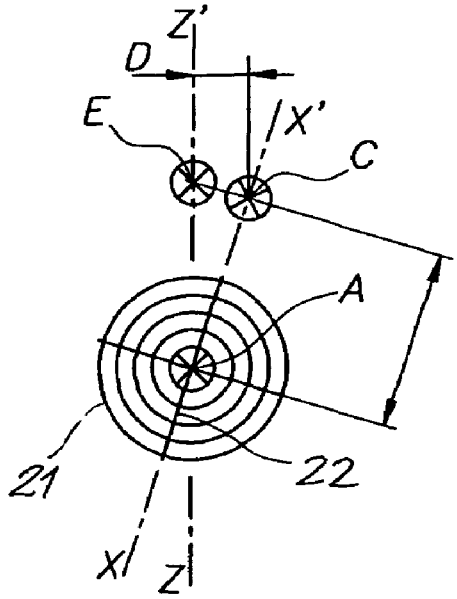
FIG. 6 is a view similar to that in FIG. 5, but for an inclined position of the device according to the invention.

In this case, the adjustment of the elevation of the frame 7 by means of the super elevation is translated by a movement of the axis of the barrel 33 in a non-vertical plane, leading to a position C as represented in FIG. 6, which results in a lateral deviation error of azimuth D in relation to the actual position of the target 21.

For this reason, the ballistic calculator 26 is provided with azimuth adjusting means making it possible to adjust the azimuth of the turret head 3 in the opposite sense so as to compensate for the deviation of the azimuth and to align the axis of the barrel 33 to the position E in the vertical plane Z-Z' of the target 21, taking into account the value of the roll angle R as measured by the sensor 30.

As the camera 15 follows the azimuth adjusting movement of the turret head 3, the display of the target 21 moves on the screen 20 and recedes over a distance F from the position of the reticule 22 in which the target 21 was aligned before the azimuth adjustment took place.

Figure 7:
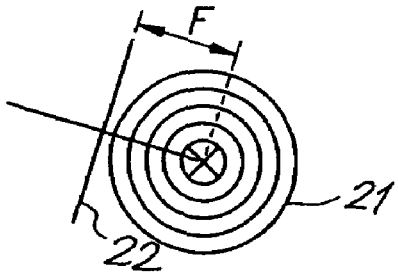
FIGS. 7 and 8 show views similar to that in FIG. 6, but at different aiming stages.

The operator then sees a display as illustrated in FIG. 7.

Figure 8:
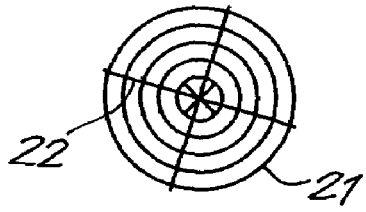

In order to be able to adjust the divergence F between the display of the target 21 and the position of the reticule 22, the device 1 preferably comprises azimuth adjustment means for the reticule 21 on screen 20, opposed to the azimuth adjustment of the turret head 3 so as to restore the position of the reticule on the target 21 as illustrated in FIG. 8.

It is clear that the azimuth adjustment of the turret head 3 and the adjustment of the position of the reticule 22 can be synchronized so as to always maintain the position of the reticule 22 on the target 21.

It is also clear that the super elevation jack 18 can be replaced by other means allowing for an upward swivel divergence of the frame 7 in relation to the camera 15.

The invention is by no means limited to the above-described examples; on the contrary, many modifications can be made to the improved device for the remote control of a firearm while still remaining within the scope of the invention as defined in the following claims.

The invention claimed is:

1. Device for the remote control of a firearm, comprising a turret head which can be pointed in all directions, controlled by an azimuth motor; a frame for fixing the firearm which is suspended in an upward tilting manner in a pintle which is part of said turret head; a sighting camera connected to a screen displaying a sighting reticule; a single elevation motor arranged to control the elevation of the frame and the camera; a remote control to control the azimuth motor and the elevation motor; one or several sensors to determine the orientation of either or both the frame and the camera and a ballistic calculator connected to said sensors to calculate and control the super elevation of the frame as a function of the information from the sensors and the distance of the target, wherein the camera is driven by the elevation motor and the frame can be inclined in elevation in relation to the camera, and wherein said frame is driven by the elevation motor via a super elevation jack placed between the frame and the elevation motor, so that the super elevation of the frame is controlled by the elongation of said jack, calculated by the ballistic calculator.

2. Device according to claim 1, wherein the super elevation jack is situated at right angles to an axis of the elevation motor and at a distance from said axis.

3. Device according to claim 1, wherein the elevation motor is directly coupled to the camera by means of a mechanical coupling.

4. Device according to claim 3, wherein the elevation motor is situated on one side of the frame, whereas the camera is situated on the other side of the frame and the mechanical coupling is formed of a mechanical bridge between the elevation motor and the camera.

5. Device according to claim 4, wherein the super elevation jack is mounted between the mechanical bridge and the frame.

6. Device according to claim 4, wherein the mechanical bridge passes beneath the frame.

7. Device according to claim 1, including a sensor to determine a roll angle of the turret head, said sensor with said azimuth motor enabling adjustment of the azimuth of the turret head so as to compensate for any azimuth deviation of the frame resulting from the super elevation of the frame when the roll angle of the turret head is not zero.

8. Device according to claim 7, further comprising azimuth adjusting means for the reticule on the screen opposed to the azimuth adjustment of the turret head so as to compensate for the azimuth adjusting movement of the turret head in order to maintain the position of the reticule on the target.

9. Device according to claim 1, including a range finder adapted to measure the distance at which the target is situated and which is connected to the ballistic calculator to calculate the super elevation.

10. Device according to claim 1, wherein the super elevation jack is provided with an encoder which is connected to the ballistic calculator to transmit the information regarding the elongation of the jack.

11. Device according to claim 1, wherein the super elevation jack is part of a stabilization system of the firearm.

* * * * *